United States Patent [19]

Barbier et al.

[11] Patent Number: 4,736,513

[45] Date of Patent: Apr. 12, 1988

[54] MINIATURE INDUCTOR AND METHOD OF MANUFACTURING SAME

[75] Inventors: Guy Barbier, Orleans; Jean-Paul Amory, Fleury les Aubrais, both of France

[73] Assignee: Acatel, Paris, France

[21] Appl. No.: 88,317

[22] Filed: Aug. 24, 1987

Related U.S. Application Data

[62] Division of Ser. No. 902,832, Sep. 2, 1986, Pat. No. 4,706,058.

[30] Foreign Application Priority Data

Sep. 19, 1985 [FR] France ..... 85 13918

[51] Int. Cl.[4] ..... H01F 7/02

[52] U.S. Cl. ..... 29/605; 29/418; 29/606; 336/96; 336/136

[58] Field of Search ..... 29/605, 606, 418; 336/96, 136

[56] References Cited

U.S. PATENT DOCUMENTS 4,425,702 1/1984 Murakami et al. ..... 29/606

*Primary Examiner*—Carl E. Hall

*Attorney, Agent, or Firm*—Sughrue, Mion, Zinn, Macpeak, and Seas

[57] ABSTRACT

A miniature variable inductor comprises a coil soldered to a pair of connecting skids. These skids are clipped to two oppositely disposed lateral walls of an injection-molded plastics cover in the shape of a hollow die. A solid part of the cover and a hollow space lie between these two walls. A central opening through these walls, the solid part of the cover and the hollow space defines a housing for a movable ferromagnetic core. There is a screwthread on at least part of this core. The coil is disposed in the aforementioned hollow space coaxially with the central opening, encapsulated in resin. The central opening has a threaded portion where it passes through the solid part of the cover. This threaded portion is complementary to the thread on the core.

1 Claim, 4 Drawing Sheets

MINIATURE INDUCTOR AND METHOD OF MANUFACTURING SAME

This is a division of application Ser. No. 902,832, filed Sept. 2, 1986, now U.S. Pat. No. 4,706,058.

BACKGROUND OF THE INVENTION

1. Field of the Invention

The present invention concerns a miniature electronic component having variable self-inductance consisting of a coil associated with a movable ferromagnetic core the depth of penetration of which into the coil is adjustable.

2. Description of the Prior Art

To simplify the manufacture of this type of component and to improve its electrical specifications it is important to minimize the number of small parts additional to the coil and to the core, and in particular to avoid the use of any form of mounting base, connecting terminals, former supporting the winding, spacers by which the coil is mounted onto the base and other parts supporting the core and enabling it to slide.

From French Pat. No. 2,486,704 it is known to do this by using a winding of thermo-adherent wire with no coil support soldered to a pair of connecting skids stamped out from a metal strip and encapsulated in a cold cast and hot polymerized resin in a flexible mold through which passes a pin forming a partially threaded axial cavity to accommodate a movable core formed by a ferromagnetic rod with a grubscrew overmolded at one end.

This type of miniature inductor sometimes has surface defects: small craters due to air bubbles trapped along the walls of the mold when the resin is cast or unwanted protrusions due to deterioration of the flexible mold. Apart from the fact that such defects are unesthetic, they may compromise the quality of the component because they can generate pockets in which are retained corrosive products from the solder flux used when mounting the component.

Molding is hardly practicable since it entails individual centering of each component. The flexible mold shrinks when it is warmed on polymerizing the resin, which alters the distance between two successive component imprints and makes it necessary to use each pair of connecting skids separately, in other words to divide up the metal strip into which they are stamped instead of retaining the strip to benefit from the resulting easy centering. Also, the thread on the pin used to form the housing for the movable core is frequently soiled by resin residues which makes it necessary to carry out delicate cleaning and checking operations, given the small size of the part concerned.

An object of the present invention is to remedy these various disadvantages while retaining a low unit cost.

SUMMARY OF THE INVENTION

In one aspect the invention consists in a miniature variable inductor comprising a coil, a pair of connecting skids to which the coil is soldered, a movable ferromagnetic core, a screwthread on at least part of the core, an injection-molded plastics cover in the form of a hollow die with two oppositely disposed lateral walls to which the connecting skids are clipped, a solid part of the cover and a hollow space between said two walls, a central opening through said two walls, the solid part of the cover and the hollow space defining a housing for the core, and a resin encapsulating the coil, which is disposed in the hollow space coaxially with the central opening, which has a threaded portion where it passes through the solid part of the cover complementary to the thread on the core.

In another aspect, the invention consists in a method of manufacturing a miniature variable inductor comprising a coil, a pair of connecting skids to which the coil is soldered, a movable ferromagnetic core, a screwthread on at least part of the core, an injection-molded plastics cover in the form of a hollow die with two oppositely disposed lateral walls to which the connecting skids are clipped, a solid part of the cover and a hollow space between said two walls, a central opening through said two walls, the solid part of the cover and the hollow space defining a housing for the core, and a resin encapsulating the coil, which is disposed in the hollow space coaxially with the central opening, which has a threaded portion where it passes through the solid part of the cover complementary to the thread on the core, which methd comprises the steps of:

making coils by winding conductive wire coated with a thermo-adherent insulative material in a warm air environment onto a temporary former and then removing the temporary former, making cores by overmolding grubscrews at one end of ferromagnetic rods the diameter of which is less than the diameter of the coils, making pairs of connecting skids by stamping them out from metal strip without separating them from the strip, so that the skids of a given pair are on opposite sides of the strip, facing each other across a distance the same as that between them in the finished inductor, the skids alternating with centering clips on the strip, injection molding plastics covers in the shape of a hollow die with two oppositely disposed walls the same distance apart as the skids of a given pair in the metal strip, each of said two walls being separated from the other by a solid part of the cover and a hollow space, a central opening matched to the dimensions of the core passing through said two walls and the solid part of the cover and being threaded in the solid part of the cover to complement the thread on the core, the hollow space being adapted to accommodate a winding coaxially with the central opening and the solid part of the cover being separated from said two lateral walls of the cover by grooves which expose the edges of said two walls, tinning and bending the ends of the coils, placing the coils on the pairs of connecting skids on the metal strip in the direction of its width and soldering their ends to the skids, placing the covers in a support having the same elongate shape as the metal strip and comprising a series of housings for the covers with the same spacing as the skids on the metal strip alternating with centering pins having the same relative disposition as the centering clips on the metal strip, each cover being disposed upside down with its central opening perpendicular to the length of the support, inserting the coils mounted on the pairs of connecting skids on the metal strip into the hollow spaces of the covers placed in the support, ensuring that the pegs locate correctly in the clips, placing a pin inside each housing of the support through a lateral opening coaxial with the central opening of the cover, the pin being shaped to define a space within which the core is to move, filling the hollow part of each cover with an encapsulating resin, removing the pin after the encapsulating resin has hardened, removing the covers from the support, separating the skids from the metal strip, and fitting the cores into the openings made by the pins.

Other characteristics and advantages of the invention will emerge from the following description of one embodiment given by way of example only and with reference to the accompanying drawings.

DESCRIPTION OF THE PREFERRED EMBODIMENT

To make the figures clearer the various component parts of the miniature inductor have been shown magnified. In reality their actual dimensions are less than one centimeter.

Figure 1:
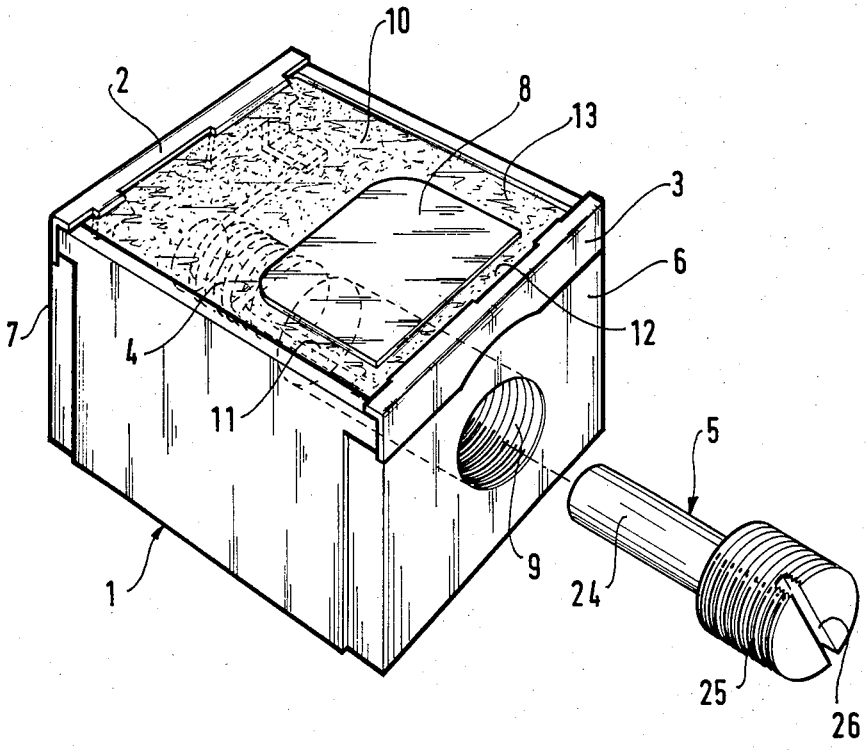
FIG. 1 shows a miniature variable inductor in accordance with the invention in perspective form below and with its movable core taken out.

As can be seen in FIG. 1 the miniature inductor is in the shape of a rectangular parallelepiped. It comprises a cover 1 carrying connecting skids 2, 3 and enclosing a cylindrical coil 4 embedded in resin and provided with a movable core 5.

The general shape of the cover 1 is that of a hollow die with the bottom open. It has two oppositely situated lateral walls 6, 7 which carry on their edges the connecting skids 2, 3 and through which passes a central opening providing a housing for the movable core 5. These two lateral walls 6, 7 are separated by a solid part 8 of the cover within which the central orifice is provided with a screwthread 9 and by a hollow part 10 which serves as a housing for the cylindrical coil 4 coaxial with the central opening. Grooves 11, 12, 13 formed around the solid part 8, along the lateral walls of the cover 1, enable a connecting skid 3 to be clipped over the edge of the lateral wall 6 adjacent the solid part 8, accommodate the electrical connection between the coil 4 and the skid 3, and allow ingress of resin from the hollow part to strengthen the fixing of the skid 3.

The connecting skids 2, 3 are identical. Their shape is seen more clearly in FIGS. 2 and 3. Each comprises a metal tongue folded longitudinally into a U shape with two wings 15, 16 of approximately the same height joined by a base 17 which straddles the edge of a wall of the cover. One of the wings, that 15 lying on the outside of the cover, has a rectangular profile in the centre of which is a large rounded notch 18 to expose the central opening serving as a housing for the movable core. The other wing 16 has two dovetail profile lugs 19, 20 which lie inside the cover and serve to anchor the skid into the encapsulating plastics material and one of which, 19, is extended laterally by an upstanding finger 21 to which one end of the coil 4 is fixed.

The movable core 5 as shown in FIG. 1 consists of a ferromagnetic rod 24 provided with a threaded head 25 complementary to the screwthread 9 in the central opening and across a diameter of which is an operating slot 26.

The miniature variable inductor which has just been described is connected to the tracks of a printed circuit or a hybrid circuit on a ceramic substrate in the same way as small electronic components in the form of slabs with connecting terminals embedded in their lateral surfaces, that is to say by forming a bead of solder at the surfaces in contact with its connecting skids or by locating spacing members there.

Manufacture may proceed as follows:

The coil 4 is made by winding a conductive wire coated with a thermo-adherent insulating material onto a temporary former in a warm air environment. The temporary former is removed when winding is completed and the ends of the coil 4 are tinned, one of them also being bent.

The movable core is made from a ferromagnetic rod having a diameter less than that of the coil and at the end of which a plastics material grubscrew is overmolded.

Figure 2:
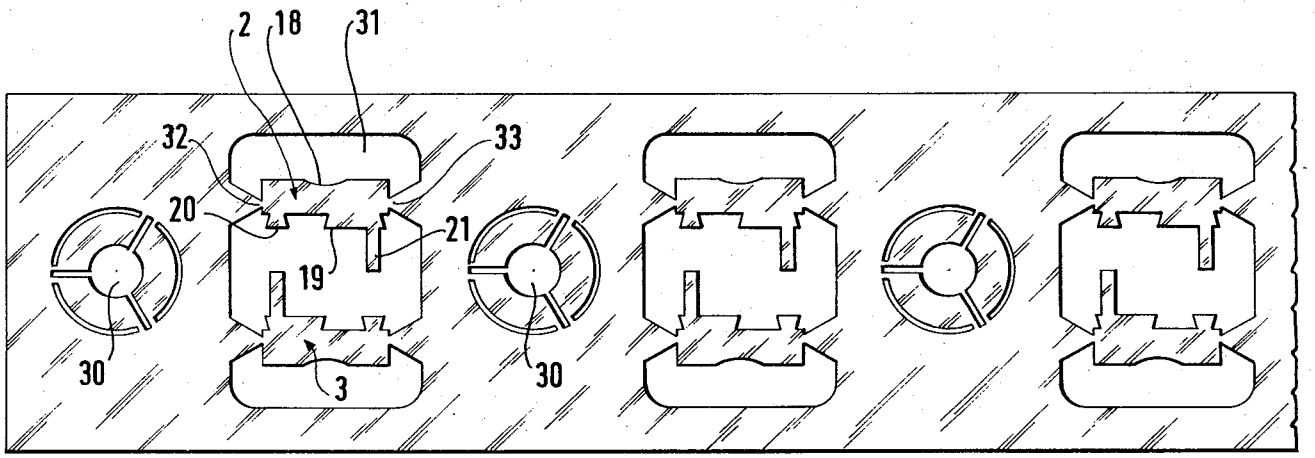
FIG. 2 shows a pre-cut metal strip from which the connecting skids of the miniature inductor shown in FIG. 1 are obtained by bending.

The connecting skids are manufactured in pairs by cutting and folding a metal strip. The strip is, for example, a strip of copper 0.1 mm thick cut out by means of a photo-etching technique, tinned by means of an electrolytic technique and then folded. FIG. 2 shows a strip of this kind after cutting and before folding. A number of pairs of skids are cut out from the strip and alternate with centering clips 30. Within each pair the skids consist of bridges spanning openings 31 and placed face-to-face in the direction of the width of the strip, at their final separation distance. These bridges are attached to the edges of the openings 31 by necks 32, 33 to facilitate their subsequent separation.

The covers with the threaded central opening in the solid part are injection molded from a heat-hardenable plastics material such as diallylphtalate, for example, in a rigid mold comprising a number of sections and internally polished in the direction in which the finished part is extracted to facilitate its removal from the mold. This injection molding technique eliminates defects of appearance, swellings and craters because of the rigidity of the mold and the good evacuation of air included in the mold made possible by the injection pressure. Also, it does not entail using any release agent.

Once the various parts have been manufactured, the assembly of the miniature inductors begins by soldering the ends of the coils 4 to the fingers 21 of the pairs of skids still attached to the original metal strip which temporarily holds them in the correct position.

Figure 3:
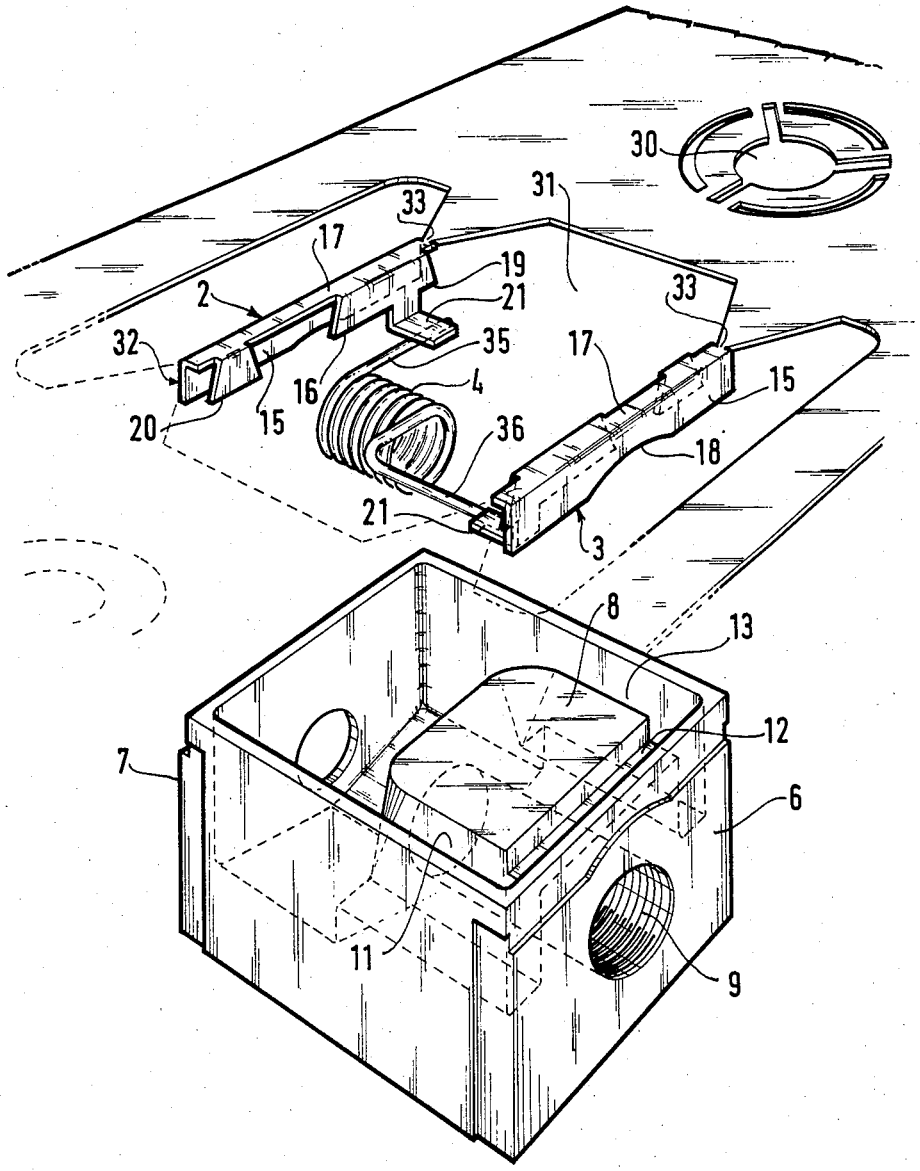
FIG. 3 shows the offering up, during assembly, of the cover of the miniature inductor from FIG. 1 to its coil previously fixed to a pair of connecting skids still attached to the metal strip.

As can be seen in FIG. 3, the coils 4 are oriented parallel to the width of the metal strip. One end 35 is not bent; it is disposed tangentially and arrives perpendicularly at the finger 21 of one of the connecting skids 2, whereas the other end 36 is bent parallel to the axis at the end of a tangential section and arrives at the finger 21 of the other connecting skid 3 axially. This arrangement makes it possible to move the coil towards one of the skids so that it is offered up facing the hollow part of the cover and leaves sufficient space relative to the other skid to accommodate the solid part 8 of the cover with the thread into which the movable core is screwed.

Figure 4:
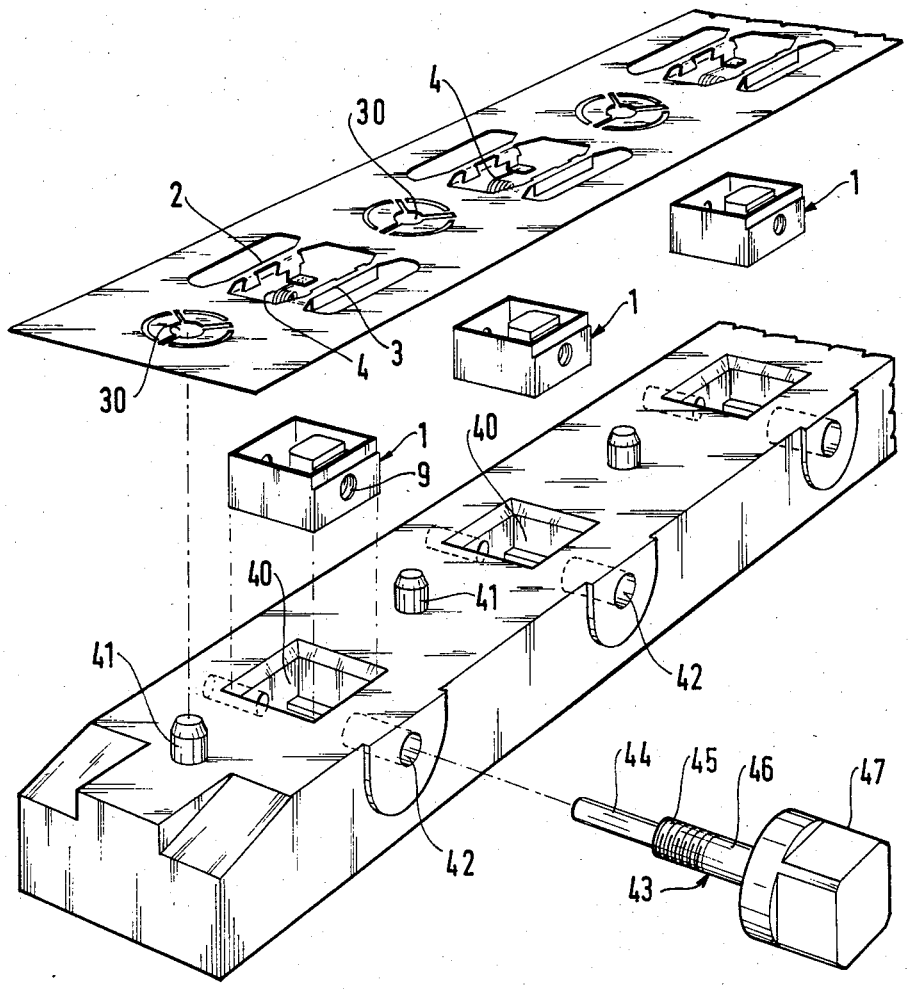
FIG. 4 shows the support used for encapsulating the coils in the covers at a preparatory stage prior to placing the covers and the metal strip carrying the coils fixed to the connecting skids.

Further assembly utilizes a rigid cover support of elongate shape. Shown in FIG. 4, it comprises a series of housings 40 aligned with the same spacing as the pairs of connecting skids on the metal strip and centering pegs 41 with the same relative disposition as the centering clips 30 on the metal strip. Each housing 40 is adapted to receive a cover 1 disposed upside down with its central opening oriented in the direction of the width of the support and comprises in its lateral walls a hole 42 coaxial with the central opening in the cover to permit the insertion of a pin 43 defining the space in which the movable core is to move. This pin 43 has a smooth end section 44 extending through the intermediary of a shoulder a threaded part 45 of larger diameter complementary to the thread 9 in the covers, itself followed by a non-threaded part 46 terminating in a handling head 47.

The injection molded covers 1 are disposed upside down in the housings 40 with their central opening aligned with the hole 42 in the support. The metal strip with the pairs of connecting skids fitted with their coils is then brought into face-to-face relationship with the support and lowered so that the coils 4 enter the hollow parts of the covers 1 and the skids straddle the edges of the lateral walls of the covers, accurate positioning resulting from guiding of the tapers at the ends of the centering pins 41 of the support in the centering clips 30 of the metal strip. Once the pegs 41 and the clips 30 have been assembled together, the pins 43 are inserted into the openings 42 in the support and screwed into the threads 9 in the covers to define the space in which the movable cores are to move inside the coils 4; the hollow part of the covers is then filled with a heat-hardenable encapsulating plastics material which flows by means of the grooves 11, 12, 13 around the solid part 8 of the cover to reach the base of the connecting skids, encapsulating their anchoring lugs, and penetrating by capillary action between them and the wall of the cover. After the encapsulating plastics material has hardened, the pins 42 are removed, the metal strip unclipped from the cover support and the miniature inductors taken out of their housing, separated from the metal strip and fitted with their movable core.

It should be noted that in this manufacturing method any possible defects in respect of external appearance can only be due to the molding of the cover and so do not entail rejection of the component.

It will be understood that various changes in the details, materials and arrangements of parts which have been herein described and illustrated in order to explain the nature of the invention may be made by those skilled in the art within the principle and scope of the invention as expressed in the appended claims.

There is claimed:

1. Method of manufacturing a miniature variable inductor comprising a coil, a pair of connecting skids to which said coil is soldered, a movable ferromagnetic core, a screwthread on at least part of said core, an injection-molded plastics cover in the form of a hollow die with two oppositely disposed lateral walls to which said connecting skids are clipped, a solid part of said cover and a hollow space between said two walls, a central opening through said two walls, said solid part of said cover and said hollow space defining a housing for said core, and a resin encapsulating said coil, which is disposed in said hollow space coaxially with said central opening, which has a threaded portion where it passes through said solid part of said cover complementary to the thread on said core, which method comprises the steps of:

making coils by winding conductive wire coated with a thermo-adherent insulative material in a warm air environment onto a temporary former and then removing said temporary former, making cores by overmolding grubscrews at one end of ferromagnetic rods the diameter of which is less than the diameter of said coils, making pairs of connecting skids by stamping them out from metal strip without separating them from said strip, so that said skids of a given pair are on opposite sides of said strip, facing each other across a distance the same as that between them in the finished inductor, said skids alternating with centering clips on said strip, injection molding plastics covers in the shape of a hollow die with two oppositely disposed walls the same distance apart as said skids of a given pair in said metal strip, each of said two walls being separated from the other by a solid part of said cover and a hollow space, a central opening matched to the dimensions of said core passing through said two walls and said solid part of said cover and being threaded in said solid part of said cover to complement said thread on said core, said hollow space being adapted to accommodate a winding coaxially with said central opening and said solid part of said cover being separated from said two lateral walls of said cover by grooves which expose the edges of said two walls, tinning and bending the ends of said coils, placing said coils on the pairs of connecting skids on said metal strip in the direction of its width and soldering their ends to said skids, placing said covers in a support having the same elongate shape as said metal strip and comprising a series of housings for said covers with the same spacing as said skids on said metal strip alternating with centering pins having the same relative disposition as said centering clips on said metal strip, each cover being disposed upside down with its central opening perpendicular to the length of said support, inserting said coils mounted on said pairs of connecting skids on said metal strip into said hollow spaces of said covers placed in said support, ensuring that said pegs locate correctly in said clips, placing a pin inside each housing of said support through a lateral opening coaxial with said central opening of said cover, said pin being shaped to define a space within which said core is to move, filling said hollow part of each cover with an encapsulating resin, removing said pin after said encapsulating resin has hardened, removing said covers from said support, separating said skids from said metal strip, and fitting said covers into said openings made by said pins.

* * * * *